United States Patent [19]

Kish

[11] 4,020,820

[45] * May 3, 1977

[54] PROCESS FOR TRUING GRINDING WHEELS

[76] Inventor: Istvan T. Kish, 16601 Excelsior Blvd., Minnetonka, Minn. 55343

[ * ] Notice: The portion of the term of this patent subsequent to Nov. 25, 1992, has been disclaimed.

[22] Filed: Nov. 24, 1975

[21] Appl. No.: 634,891

Related U.S. Application Data

[63] Continuation-in-part of Ser. No. 452,438, March 18, 1974, Pat. No. 3,921,616.

[52] U.S. Cl. ..... 125/11 R; 51/283; 51/293; 125/11 CD

[51] Int. Cl.[2] ..... B24B 53/06

[58] Field of Search ..... 125/11 R, 11 CD; 51/262 T, 281 R, 283, 309, 293

[56] References Cited

UNITED STATES PATENTS

| | | | |
|---|---|---|---|
| 1,590,386 | 6/1926 | Lavallee | 51/262 T |
| 2,947,302 | 8/1960 | Patterson | 125/11 CD |
| 3,078,835 | 2/1963 | Thomas | 51/281 R |
| 3,424,566 | 1/1969 | Kuenstle et al. | 51/295 |
| 3,528,788 | 9/1970 | Seal | 51/309 |
| 3,553,905 | 1/1971 | Lemelson | 51/206 R |
| 3,921,616 | 11/1975 | Kish | 125/11 CD |

*Primary Examiner*—Harold D. Whitehead
*Attorney, Agent, or Firm*—Williamson, Bains & Moore

[57] ABSTRACT

A process for truing bonded, diamond and boron nitride grinding wheels utilizing a special tool made of molybdenum, or closely related metals including tantalum and columbium as the truing or dressing tool. Such a special tool is held in frictional contact with the peripheral work surface of the diamond or boron nitride grinding wheel as it rotates on a spindle, with the tool either being stationary, or movable through a predetermined path to form a work surface of particular shape on the periphery of the diamond grinding wheel.

8 Claims, 5 Drawing Figures

PROCESS FOR TRUING GRINDING WHEELS

This application is a continuation-in-part of my copending application, Ser. No. 452,438 filed on Mar. 18, 1974, now U.S. Pat. No. 3,921,616, issued Nov. 25, 1975, and entitled PROCESS FOR TRUING A DIAMOND WHEEL UTILIZING A MOLYBDENUM TOOL.

BACKGROUND OF THE INVENTION

For particular types of finishing and forming operations, diamond grinding wheels are used. For example, resin bonded, diamond grinding wheels are required where close tolerances and extremely smooth finishes are necessary, as in the forming of carbide and tungsten carbide tools. Bonded grinding wheels incorporating boron nitride as an abrasive have also proven to be satisfactory for many of these same applications, with the exception of carbide grinding. Boron nitride is manufactured abrasive having qualities of hardness similar to diamond. Such grinding wheels, like abrasive wheels of any kind, must be trued or dressed from time to time as they wear in order that they may accurately form fine finishes or precise contour on work pieces, such as tools. Precision grinding utilizing diamond and boron oxide wheels is becoming less and less popular because it is so difficult to establish and maintain the proper dress on such grinding wheels. The silicon carbide and aluminum oxide tools used in the past to dress grinding wheels of this type wear away so rapidly when held in frictional contact with a rotating diamond or boron oxide wheel during a dressing operation that it is extremely difficult to accurately dress such wheels with these tools. Even if sufficient material can eventually be removed from wheels having such hard abrasives as diamond and boron oxide using such tools in a dressing operation, the tremendous wear rate of such tools against wheels of this type requires the use of excessive quantities of silicon carbide or aluminum oxide tools. Also, the heat and dust generated in using silicon carbide or aluminum oxide tools to dress diamond or boron nitride grinding wheel is highly undesirable.

I have discovered that the aforesaid difficulties can be overcome, and that the highly effective, accurate and economical truing and dressing of a bonded, diamond or boron nitride grinding wheel can be accomplished using a molybdenum tool or a tool made of the closely related metals tantalum and columbium.

BRIEF SUMMARY OF THE INVENTION

The process of this invention for truing and dressing a bonded, diamond or boron nitride grinding wheel is particularly characterized by the use of a special dressing tool in such a way that an accurate surface of predetermined shape can be formed on such grinding wheels with the generation of a minimum amount of heat and dust while wearing away a very minimum amount of the tool in comparison with the use ratios of prior tools utilized for dressing such wheels.

These basic advantages are achieved by utilizing a tool comprised primarily of molybdenum or of the similar metals tantalum and columbium, and preferably having a purity of at least ninety five percent. The tool may take various shapes, such as that of a cylinder, disc, bar, or pointed tip, and may be held in a fixed position or moved through a predetermined path as desired in frictional contact with the peripheral work surface of the rotating grinding wheel to accurately form a true work surface of desired contour thereon.

As a particularly beneficial aspect of my improved diamond and boron nitride wheel dressing process, the molybdenum, tantalum or columbium tool may be used to dress a bonded, diamond or boron oxide wheel while the wheel remains mounted on its normal work spindle of a grinding machine, the work spindle being utilized to rotate the wheel during the truing and dressing operation. This is in contrast to previously used methods for dressing such wheels, in which the high wear ratio of prior dressing materials has required the use of particularly large dressing tools and the mounting of such grinding wheels on special dressing machines permitting access of the large dressing tools to the periphery of the wheel.

These and other objects and advantages of my invention will become readily apparent as the following description is read in conjunction with the accompanying drawings wherein like reference numerals have been used to designate like elements throughout the several views.

DESCRIPTION OF THE PREFERRED EMBODIMENTS

Figure 1:
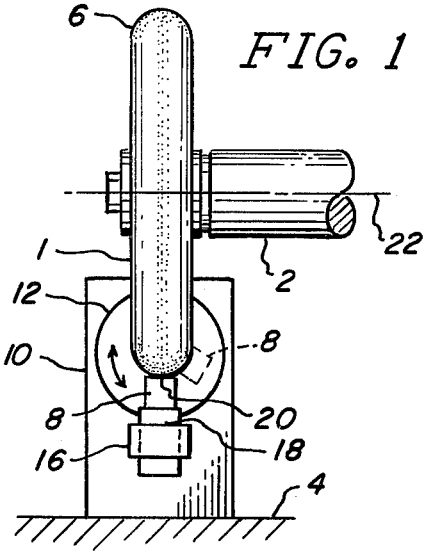
FIG. 1 is a front elevation view in simplified form of a grinding wheel and tool positioned to utilize the truing process of this invention.

The grinding wheel truing process set forth herein has proven to be particularly effective on two types of grinding wheels. These are resin bonded, diamond grinding wheels and resin bonded, boron nitride wheels. As is well known, such grinding wheels have the diamond or boron nitride abrasive particles imbedded and held in a bonding agent in the form of a resin of some type. For example, the bonding resin may be Bakelite. Boron nitride, or cubic boron nitride as it is sometimes called, is a commercially available product manufactured and sold by General Electric Company under the trademark Borazon. It is synthetically manufactured utilizing high temperature and high pressure techniques very similar to those employed in producing man-made diamond. The similarity between boron nitride and diamond is evidenced by the fact that boron nitride is almost as hard as diamond, and is several times harder than silicon carbide and aluminum oxide. On the Knoop Hardness Scale, diamond has a hardness rating of 7,000, Borazon is rated at 4700, and silicon carbide at 2480. Boron nitride is used as an abrasive in the grinding of high speed and tool steels. It is not suitable for grinding carbides, including tungsten carbide. Abrasive particles of boron nitride are imbedded in resin bond systems, much in the same manner as diamond particles, in manufacturing grinding wheels.

Referring now to the drawings, I have shown in FIG. 1 and 2 one type of setup for a dressing operation on a grinding wheel utilizing a molybdenum tool or one of the other special tools hereinafter identified. The grinding wheel 1 is shown mounted on a drive spindle 2 with which it can be rotated at a desired speed in carrying out a truing or dressing operation on the wheel. The grinding wheel will necessarily be a resin bonded, diamond or boron nitride grinding wheel, as described above, since these are particular types of wheels with which the tools disclosed herein have proven to be particularly effective in a truing operation. Such wheels are to be distinguished from so-called metal bonded diamond wheels with which the molybdenum and other specified tools of may improved truing process have not been particularly effective. Although the spindle 2 on which grinding wheel 1 is mounted for the dressing operation may be a rotary spindle on any type of machine, including that a special dressing machine, I have found that my dressing process may be advantageously utilized to true a resin bonded, diamond or boron nitride grinding wheel while it is mounted on its normal work spindle of a grinding machine. Grinding machines of various types are well known, and therefore no such machine is illustrated in detail. It will suffice to say that work spindle 2 is rotatably supported on such a machine and is driven by a motor to operate within a predetermined speed range. The work bed of the grinding machine is indicated by reference numeral 4.

Figure 2:
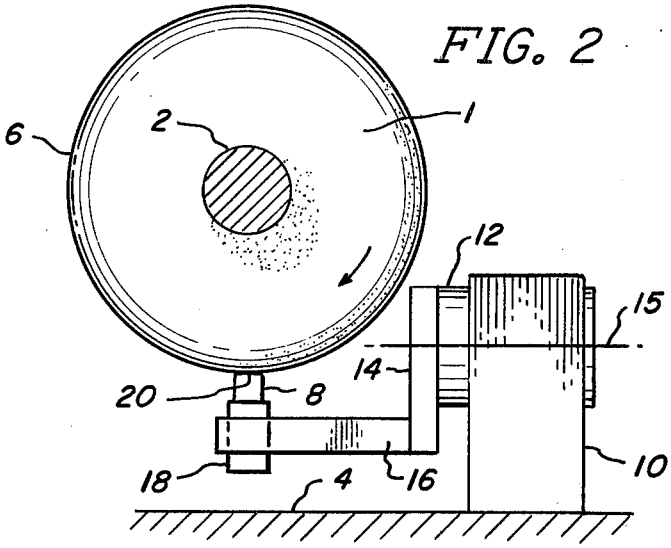
FIG. 2 is a side elevation view of the tool and wheel arrangement of FIG. 1.

The peripheral work surface 6 around the circumference of grinding wheel 1 is shown with an arcuate shape with a radius formed thereon, for illustrative purposes in FIGS. 1 and 2. As is pointed out below, grinding wheels having contours of various configurations on their peripheral surfaces may be dressed with the special tool process of this invention. For truing a diamond or boron nitride grinding wheel having such an arcuate peripheral work surface, a bar type molybdenum tool 8 is preferably utilized. Such an elongated, molybdenum bar formed from molybdenum bar stock of commercial grade and quality has been successfully used to dress both resin bonded, diamond and boron nitride grinding wheels. Although such commercial quality molybdenum would normally be over 99 percent pure, a molybdenum tool, in whatever form utilized in my dressing process, would provide satisfactory results if it were of at least 95 percent pure molybdenum. In the dressing setup shown in FIGS. 1 and 2, molybdenum bar tool 8 is held in a dressing fixture 10 which may be advantageously secured in place on the work bed 4 of the grinding machine on which diamond wheel 1 is mounted for normal grinding operations. Tool support fixture 10 has a rotary head 12 with an upright member 14 affixed thereto for rotation about the rotary axis 15 of head 12. Projecting forwardly from upright member 14 at substantially right angles thereto is a tool mounting arm 16 apertured at its outer end to receive a tool holding sleeve 18. Tool bar 8 of molybdenum or other specific metal identified below is removably secured within sleeve 18 in the upright position shown in FIGS. 1 and 2. Tool bar 8 is so mounted that its outer, flat tip portion 20 is in contact with the peripheral work surface 6 of the grinding wheel 1.

A truing operation is carried out on grinding wheel 1 using the aforesaid setup, by said rotating grinding wheel 1 at a predetermined speed with work spindle 2. Simultaneously, as wheel 1 is rotating, rotary head 12 of the tool fixture is rotated about axis 15 in a reciprocating fashion as indicated by the directional arrow in FIG. 1, to thereby move the work tip 20 of tool bar 8 back and forth in an arcuate path over the circumferential, peripheral edge surface 6 of grinding wheel 1 as it rotates. Tool bar 8 is moved generally transversely of the peripheral work surface 6 of grinding wheel 1 in a vertical plane which will normally be oriented at right angles with respect to the plane of grinding wheel 1. The arcuate movement of tool bar 8 over the entire peripheral work surface 6 of grinding wheel 1 is illustrated in FIG. 1 by showing tool bar 8 in phantom lines in one of the positions it will assume during the truing operation.

Figure 5:
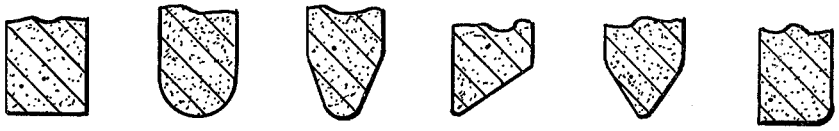
FIG. 5 illustrates a variety of grinding wheel shapes which can be formed with the truing process of FIGS. 1 and 2.

By moving molydenum tool bar 8 back and forth through an arcuate path with its tip 20 in frictional contact with the peripheral work surface 6 of wheel 1 as it rotates, tool bar 8 will form a precise radius on the peripheral work surface 6 of wheel 1 to thereby provide the exact arcuate contour of predetermined radius required on peripheral work surface 6. It is to be noted that with the dressing setup shown in FIGS. 1 and 2, the rotational axis 22 of grinding wheel 1 extends substantially perpendicular to the plane of wheel 1. For forming a predetermined radius on the peripheral work surface 6 of wheel 1, tool bar 8 is preferably mounted as shown in FIGS. 1 and 2 with its elongated support arm 16 extending at right angles to rotational axis 22 of grinding wheel 1. Those skilled in the art will appreciate that tool bar 8 could be held stationary, or moved through various types of predetermined paths in order to true a flat or arcuate surface of particular contour on the peripheral work surface or a grinding wheel. In FIG. 5 I have illustrated in cross section a number of radius and angled surfaces which can accurately be formed on a resin bonded, diamond or boron nitride grinding wheel using a molybdenum or other special tool bar 8 mounted on a radius-angle dresser secured in place on a work bed 4 of a grinding machine so as to hold the tool bar in proper position with respect to the peripheral work surface of a grinding wheel 1. It will be appreciated that the dressing setup illustrated in FIGS. 1 and 2 is primarily intended for generating convex forms, such as radii and angles, singly or in combinations as illustrated in FIG. 5, on the peripheral work surface of the grinding wheel.

Figure 3:
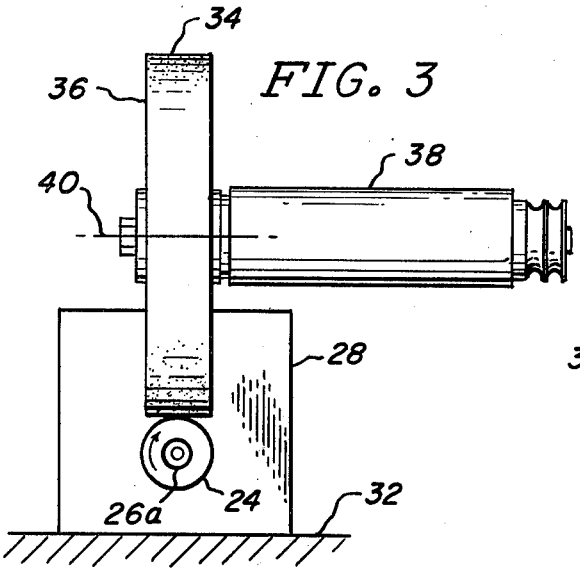
FIG. 3 is a front elevation view showing an alternative form and arrangement of a truing tool in accordance with my invention.
Figure 4:
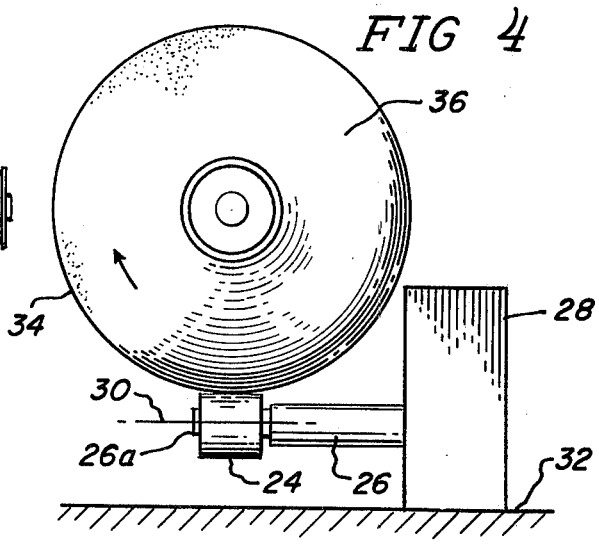
FIG. 4 is a side elevation view of the tool and grinding wheel arrangement of FIG. 3.

In FIGS. 3 and 4 I have shown an alternative setup for a dressing operation utilizing a molybdenum or other appropriate metal tool 24 of cylindrical shape. Tool 24 is mounted on the forward end 26a of a drive spindle 26 rotatably supported on a fixture 28. Drive spindle 26 is supported for rotational movement about its longitudinal axis 30, and is driven by a motor not shown, as is rotary head 12 of tool support fixture 10 shown in FIGS. 1 and 2. As is the case with respect to the tool setup of FIGS. 1 and 2, tool mounting FIG. 28 is directly supported on the work bed 32 of a grinding machine of conventional design. Drive spindle 26 is so positioned that tool cylinder 24 will be positioned as shown with its cylindrical peripheral surface in tangential line contact with the circular peripheral work surface 34 of a grinding wheel 36. Wheel 36 would also be a resin bonded, diamond or boron nitride grinding wheel of the type with which the molybdenum and other truing tools specified herein have proven to be particularly efficient and effective. Grinding wheel 36 is shown mounted on a spindle 38 for rotation with the spindle about its longitudinal axis 40. Although a special work spindle on a dressing machine could be utilized to support and rotate grinding wheel 36 during a truing operation, spindle 38 will preferably be the normal work spindle of a grinding machine on which diamond or boron nitride wheel 36 is normally mounted for grinding operations. Tool support fixture 28 is supported on the work bed 32 of the grinding machine at a position such that tool 24 will be positioned as shown in frictional contact with the peripheral surface 34 of wheel 36.

With work spindle 38 driving grinding wheel 36 at a predetermined speed, molybdenum tool cylinder 24 is imultaneously rotated in frictional contact with the peripheral work surface 34 of wheel 36. The rotational axis 30 for cylindrical molybdenum tool 24 is disposed substantially at right angles to the rotational axis 40 of grinding wheel work spindle 38. Thus, with molybdenum tool 24 being a right cylinder, as shown, it will true and form a substantially flat or straight surface on the circular periphery 34 of grinding wheel 36. In order to form an accurate, flat work surface over the entire periphery 34 of diamond or boron nitride grinding wheel 36, molybdenum tool cylinder 24 may be reciprocated horizontally in a direction parallel to the rotational axis 40 of wheel 36. This may readily be accomplished by reciprocating the work bed 32 of the grinding machine on which tool fixture 28 is mounted, such work beds of grinding machines normally being reciprocal in a horizontal plane for the purpose of moving a work piece back and forth under a grinding wheel during a finishing operation.

Although the dressing setup of FIGS. 3 and 4 shows an elongated, cylindrical tool, I contemplate that a disc-type cylindrical segment of shorter length could also be used in such a setup. The elongated cylindrical tool 24 shown in FIGS. 3 and 4 has the advantage that it presents a substantial length of tool surface to the peripheral surface 34 of grinding wheel 36, and therefore will not wear away as quickly as would a thin, disc-like dressing tool. Also, in addition to the bar and cylinder type dressing tools disclosed in FIGS. 1 through 4, I contemplate that other types and shapes of tools could be used satisfactorily in dressing a resin bonded, diamond or boron nitride grinding wheel. For example, the tool could be a bar or rod with a pointed tip, or possibly even a flat plate against which the peripheral surface of a grinding wheel would rotate during a truing operation.

I have found that particularly accurate truing and dressing of resin bonded, diamond and boron nitride grinding wheels with a minimum of wear of the dressing tool can be accomplished utilizing a cold rolled molybdenum tool. The reason for improved performance with such a cold rolled molybdenum tool is not precisely known. However, different metallurgical properties, including grain dispersion and hardness are apparently achieved in a cold rolled molybdenum tool, in contrast to a hot worked molybdenum tool, which may account for the improved results when such a tool is used to dress a resin bonded, diamond or boron nitride wheel.

In my above-identified copending application, the advantages of molybdenum in truing and dressing diamond grinding wheels are set forth. Continuing tests have confirmed that certain other metals of those closely related to molybdenum in physical and chemical properties also are demonstrably superior to truing tools previously utilized in truing diamond and boron nitride wheels. Those metallic elements which have proven to be particularly satisfactory for this purpose are those belonging to the family of metals wich are highly reactive and have a strong affinity for carbon. These especially include tantalum and columbium, based on test results. The closeness of the atomic number of tantalum to molybdenum and their close relationship in the periodic table of elements is to be noted. Columbium is very similar to tantalum chemically. Such metals form their own oxide easily; and when the oxide is removed, and the pure metal is exposed, these metals bond themselves easily to other metals. In an action which might best be described as "metallic wetting" these metals will adhere to most other materials. This characteristic permits a metallic wetting action between such metals and diamond or boron nitride, thereby assisting in the removal of these abrasives as relative movement and frictional contact takes place between the treating metal and these abrasives during a truing operation. Any oxides on the treating metal; e.g., molybdenum, tantalum or columbium, are removed by the heat and abrasion generated in a truing or dressing operation.

Tantalum and columbium are both more expensive than molybdenum, but may prove to be commercially desirable because of their effectiveness in truing and dressing resin bonded, diamond and boron nitride grinding wheels. When used as truing tools, these metals, like molybdenum, have a low wear ratio in comparison with diamond or boron nitride grinding wheels. When formed into truing tools, tantalum and columbium are preferably utilized in the relatively pure form available commercially. Any filler material or alloy in the truing tool will become imbedded in the grinding wheel, and "load-up" the grinding wheel during a truing or dressing operation; and this results in a filler glaze being left on the grinding wheel which must be removed in a subsequent dressing operation in order to expose the abrasive particles; e.g., diamond or boron nitride. When utilized for truing and dressing purposes, such highly reactive metals as tantalum and columbium may take the same form as any of the tools described above, including the specific tools designated by reference numerals 8 and 24.

One of the most important advantages achieved by the use of the molybdenum and other metallic material as disclosed herein for dressing or truing a resin bonded, diamond or boron nitride grinding wheel is the low wear ratio of such tools with respect to the grinding wheel. Silicon carbide and aluminum oxide tools which have traditionally been used for dressing diamond grinding wheels of both resin bonded, and metal bonded types, have had wear ratios of as high as 100 to 1. That is to say, 100 times as much of such dressing tools wears away during a dressing operation as does the resin bonded, diamond wheel. For example, molybdenum dressing tools used in truing operations as disclosed herein have shown a very minimal wear ratio of the tool to the grinding wheel of only about 2 to 1. This small amount of wear of the molybdenum tool in comparison with that of prior tools utilized for dressing resin bonded and boron nitride diamond wheels, also explains to a large degree the minimum amount of dust and heat generated during a truing operation utilizing a molybdenum tool. Silicon carbide tools, for example, wear away so rapidly when used for dressing a diamond grinding wheel, that a tremendous amount of dust and heat is generated. This is highly undesirable for obvious reasons, and special vacuum pickup devices must be utilized to remove the dust during the dressing operation. Utilizing a molybdenum dressing tool on a resin bonded, diamond grinding wheel, I have found that the temperatures generated are so low that either the grinding wheel or the molybdenum dressing tool can safely be touched by hand immediately after a truing operation has been completed. Neither the grinding wheel itself, or the molybdenum tool reach a temperature in excess of 200° F during a truing operation.

One of the significant problems directly related to the high temperatures generated in truing diamond wheels with aluminum oxide or silicon carbide tools is burning and glazing of the peripheral surface of the resin bonded, diamond wheels during the truing operation. The high temperatures encountered with such tools cause the resin bonding elements to melt and glaze over and around the diamond particles on the periphery of the grinding wheel. As a result, a final dressing operation utilizing a separate abrasive is frequently required to open up the peripheral surface of a resin bonded, diamond grinding wheel to expose the tips of diamond particles after a truing operation utilizing a silicon carbide or aluminum oxide tool. The molybdenum and other metallic truing tools disclosed herein produce a more open face initially on the peripheral surface of a resin bonded, diamond wheel with good exposure of diamond particles. There is no need for a final, additional dressing operation utilizing a special abrasive after the initial tool truing process, since the temperatures generated in the use of a molybdenum, tantalum or columbium tool against a resin bonded diamond wheel are not high enough to melt and glaze the resin bonding material. The high temperatures, glazing of the bonding agents, and high wear ratios with resulting dust generation encountered with previously known truing techniques, make it very difficult to obtain the necessary accurate contours on diamond and boron nitride wheels required for precision grinding operations utilizing such wheels. As a result, much more accurate, finer finishes can be achieved on work pieces, and particularly on carbide and tungsten carbide tools, using a molybdenum dressed, resin bonded diamond wheel. For example, I have been able to achieve finishes with tolerances as close as 2 micro inches with a resin bonded, diamond grinding wheel dressed with a molybdenum tool. This is in contrast to the finishes of 15 to 20 micro inches achievable in the past with conventionally trued and dressed resin bonded, diamond wheels.

Another particularly significant benefit realized from the use of metallic dressing tools as disclosed herein to true resin bonded, diamond and boron nitride grinding wheels is that the truing operation can be carried out with such grinding wheels mounted on their normal work spindles of a grinding machine. The tremendously high wear rate of silicon carbide and aluminum oxide tools used in the past to true and dress diamond grinding wheels has required the use of particularly large tools in the nature of bars or cylinders of such dressing materials. Such tools are so large that they cannot be mounted in a fixture and positioned in working relation to a grinding wheel with the grinding wheel mounted on its work spindle on an ordinary grinding machine. Traditionally, the grinding wheel has been removed from its work spindle and mounted on the spindle of a special truing and dressing machine utilizing a relatively large aluminum oxide or silicon carbide tool, such as a very large diameter silicon carbide disc or cylinder. Because of the extremely high wear rate of such prior dressing materials, it is simply impractical to attempt to use the small tools in the nature of small discs or bars, which will be required to achieve access to the periphery of a diamond wheel mounted on its normal work spindle. Such small tools as those illustrated in FIGS. 1 through 4 in the nature of tool bars or cylinders not over several inches long or several inches in diameter would simply wear away so quickly if made from silicon carbide or aluminum oxide and used to dress a diamond or boron nitride wheel, that the tools would have to be replaced repeatedly without actually removing any significant aount of material from the periphery of the grinding wheel. The minimum wear ratio of tool to diamond or boron nitride wheel achieved with my molybdenum and other special, metallic tools overcomes these problems, and permits a very small tool to be used to dress a resin bonded, diamond or boron nitride grinding wheel with the wheel mounted on its normal work spindle. Thus, the grinding wheel does not have to be removed from its machine and placed on a special drive spindle of a truing machine to carry out a truing operation. As will be appreciated by those skilled in the art, this necessarily improves the accuracy which can be achieved in the form dressing of a diamond grinding wheel utilizing a truing tool with the grinding wheel mounted on its work spindle. If the grinding wheel has to be transferred from one spindle to another in the course of a truing operation, accuracy in the truing operation will necessarily be lost because of unavoidable differences in tolerances between the work spindle of a grinding machine and the special drive spindle of a dressing machine on which the wheel would be mounted during a dressing operation. The relatively low wear ratio of the molybdenum and other metallic tools disclosed herein with respect to a resin bonded, diamond wheel permits a relatively small tool such as those shown in FIGS. 1 through 4 to accomplish the dressing operation with the diamond wheel rotating on its normal work spindle of a grinding machine. A small molybdenum tool can readily be mounted in conventional radius-angle dressing devices such as those shown in FIGS. 1 through 4, and positioned in working relation to the peripheral surface of a grinding wheel with the tool fixture mounted on the work bed of the grinding machine. As noted above, it would be impossible to achieve access to the peripheral surface of a grinding wheel mounted on its normal work spindle if a large tool had to be used in the truing operation, as is the case with previously utilized silicon carbide and aluminum oxide tools.

When a truing or dressing operation is carried out in the preferred manner with the grinding wheel mounted on its work spindle, the wheel will be rotated during the dressing operation within a predetermined speed range available on the grinding machine. Normally, the speed range availability on conventional grinding machines is between 5000 and 5500 surface feet per minute. Satisfactory truing results have been achieved using a molybdenum tool held in frictional contact with the work surface of a grinding wheel rotating within such a speed range. However, improved results in the form of particularly accurate finishes and minimum wear of the molybdenum tool have been achieved with the grinding wheel operating at slower speeds within a range of from 600 to 700 surface feet per minute. Such lower speed ranges for the grinding wheel work spindle are available only on certain types of grinding machines utilized for special forming operations.

The easier, less expensive and more accurate truing of resin bonded, diamond grinding wheels possible with the use of special metallic tools as described herein with the grinding wheel mounted on its normal work spindle, will make the forming of carbide and tungsten carbide tools by means of diamond grinding wheels much more feasible and attactive to tool makers. Presently, machinists avoid making carbide tools because it is so difficult to maintain and control the proper dress on diamond grinding wheels required for the finishing of carbide tools and work pieces of any kind. This is considered to be a significant benefit, since carbide tools wear so much better and last so much longer than steel tools.

Although I have described my improved truing and dressing process for resin bonded, and boron nitride wheels with respect to particular metallic tools and tool setups, I anticipate that various changes may be made in the size, shape, and arrangement of the tools without departing from the spirit and scope of this invention as defined by the following claims.

What is claimed is:

1. A process for truing a resin bonded grinding wheel having abrasive particles selected from the group consisting of diamond an boron nitride held in a bonding agent, comprising:

rotating a resin bonded grinding wheel having bonded abrasive particles selected from the group consisting of diamond and boron nitride about a rotational axis extending substantially normal to the plane of the wheel; and simultaneously holding a tool in frictional contact with the peripheral work surface of said grinding wheel while it rotates, said tool being made from one of a group of related metal consisting of molybdenum, tantalum and columbium.

2. The grinding wheel truing process as defined in claim 1 wherein:

said tool is commercial quality of at least ninety percent purity with respect to the selected one of said group of metals.

3. The grinding wheel truing process as defined in claim 1 wherein:

said grinding wheel is mounted on its normal work spindle of a grinding machine during said truing operation, with said tool being moved into frictional contact with the peripheral work surface of said grinding wheel as it rotates on its work spindle; and moving said tool back and forth through an arcuate path over the circumferential, peripheral edge surface of said grinding wheel transversely of said edge surface in a plane angularly oriented with respect to the plane of said grinding wheel as said grinding wheel rotates on said work spindle, thereby forming an arcuate peripheral work surface around the circumference of said grinding wheel.

4. The grinding wheel truing process is defined in claim 3 wherein:

said tool is in the form of a bar having a tip held in contact with the peripheral edge surface of said grinding wheel as said bar is moved back and forth through said arcuate path with said grinding wheel rotating on its work spindle.

5. A process for truing a resin bonded, boron nitride grinding wheel comprising:

rotating a resin bonded, boron nitride grinding wheel about a rotational axis extending substantially normal to the plane of the wheel; and simultaneously holding a molybdenum tool in frictional contact with the peripheral work surface of said grinding wheel while it rotates.

6. The boron nitride grinding wheel truing process as defined in claim 5 wherein:

said molybdenum tool is commercially quality molybdenum of at least ninety-five percent purity.

7. A process for truing a resin bonded grinding wheel comprising:

rotating a resin bonded grinding wheel with a work spindle of a grinding machine on which said grinding wheel is normally mounted for grinding operations, said grinding wheel having abrasive particles selected from the group consisting of diamond and boron nitrate held in a bonding agent; and simultaneously holding a truing tool in frictional contact with the peripheral work surface of said grinding wheel while it is rotating, said tool being made from one of a group of related metals consisting of molybdenum, tantalum and columbium.

8. The grinding wheel truing process as defined in claim 7 wherein:

said tool is in the form of a cylindrical member which is rotated about its longitudinal axis during said truing process with its cylindrical peripheral surface in tangential line contact with the circular peripheral work surface of said grinding wheel as it rotates.

* * * * *

UNITED STATES PATENT AND TRADEMARK OFFICE

CERTIFICATE OF CORRECTION

PATENT NO. : 4,020,820

DATED : May 3, 1977

INVENTOR(S) : Istvan T. Kish

It is certified that error appears in the above-identified patent and that said Letters Patent are hereby corrected as shown below:

In claim 6, line 26, change "commercially" to --commercial--.

In claim 7, line 35, change "nitrate" to --nitride--.

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*